US005293426A

United States Patent [19]

Wouch et al.

[11] Patent Number: 5,293,426

[45] Date of Patent: Mar. 8, 1994

[54] PRINTING CYLINDER ENGRAVER CALIBRATION SYSTEM AND METHOD

[75] Inventors: Gerald Wouch, Lisle; Gary Procknow, Chicago, both of Ill.

[73] Assignee: R. R. Donnelley & Sons Company, Chicago, Ill.

[21] Appl. No.: 529,108

[22] Filed: May 25, 1990

[51] Int. Cl.[5] ..... B41C 1/00

[52] U.S. Cl. ..... 382/1; 382/8; 101/401.1; 358/299; 356/378

[58] Field of Search ..... 382/8, 1; 356/394, 378, 356/379; 101/401.1; 156/626, 627; 358/299

[56] References Cited

U.S. PATENT DOCUMENTS

| | | | |
|---|---|---|---|
| 3,808,878 | 5/1974 | Dini | 73/67.8 |
| 3,885,422 | 5/1975 | Dini | 156/626 |
| 3,931,570 | 1/1976 | George et al. | 156/626 |
| 4,003,311 | 1/1977 | Bardin | 101/426 |
| 4,072,928 | 2/1978 | Wilder | 340/146.3 |
| 4,408,883 | 10/1983 | Iwamoto et al. | 356/355 |
| 4,612,584 | 9/1986 | George et al. | 358/299 |
| 5,229,861 | 7/1993 | Nozaka et al. | 358/299 |

*Primary Examiner*—Joseph Mancuso
*Assistant Examiner*—Steven P. Klocinski
*Attorney, Agent, or Firm*—Arnold, White & Durkee

[57] ABSTRACT

A system for calibrating engraving heads used for engraving gravure printing cylinders determines a cell volume for cells formed in a test cut in a printing cylinder. The system of the present invention includes a procedure of cutting two or more test cuts in each printing cylinder. One of the test cuts is at the light end of the cylinder and the second is at the dark end. The morphological characteristics of each individual cell in each of the test cuts is measured, and the average cell dimensions and volume per unit area are computed. These average values are compared with desired average values, and each engraving head is adjusted in accordance with this comparison to cut the desired values within an acceptable tolerance band. The desired average values can be adjusted to take into account new inks, papers, batch variations in inks and papers, and diamond wear in the engraving head.

24 Claims, 3 Drawing Sheets

PRINTING CYLINDER ENGRAVER CALIBRATION SYSTEM AND METHOD

FIELD OF THE INVENTION

The calibration system of the present invention generally relates to a new and improved system and method for calibrating the engraving head of a machine used to engrave a gravure printing cylinder or a similar printing member; and to a new and improved system and method for rapidly measuring morphological features of each cell in a test cut in a gravure printing cylinder and computing the average values and other statistical quantities of those cells in order to calibrate an engraving head.

DESCRIPTION OF THE PRIOR ART

Gravure printing is done on presses using printing images engraved on the surface of a cylinder. Consequently, the printing plates are cylindrical and are engraved to create cells or depressions in the printing areas. To print using these cylinders (or surfaces), the cells or depressions are filled with ink, and a doctor blade removes excess ink from the nonprinting areas. These cells or depressions are engraved into a gravure cylinder by an engraving head of an engraver or engraving machine such as a Helio-Klischograph manufactured by Dr. Ing. Rudolf Hell GmbH. The engraving head includes a diamond stylus for a cutting tool.

Prior to engraving a gravure cylinder, each engraving head of the engraver is calibrated. Calibration is performed by engraving selected tone steps called test cuts on the gravure cylinder. Each test cut is composed of a collection of preferably identical cells. Typically, two test cuts are made before an image is engraved onto the gravure cylinder. Normally, one test cut is engraved at the light end of the image which is a tone step corresponding to an optical density of about 0.03. A second test cut is normally made at the dark end or shadows of the image and is a tone step corresponding to a density of about 1.65. Tests cuts are not usually made in the midtone areas which normally occur at an optical density of approximately 0.33.

To calibrate the engraving head, an operator chooses a single representative cell out of an engraved test cut and measures the width of that cell with an optical microscope. An adjustment is then made to the engraving head to cut a cell of the desired width. A second test cut is usually not made to check whether or not a cell of the desired width is actually produced after calibration. This procedure is performed for each of the two tone steps for each engraving head.

There are several features of this procedure that results in error and resultant incorrect calibration. For example, this procedure depends on an arbitrary selection of a single cell in the test cut, and it is assumed that this single cell is representative of the size and volume of all of the cells in the test cut. Moreover, this procedure assumes that the engraving head which uses a diamond stylus to cut each cell, cuts the same size cell when supplied with a consistent digital value from the control system of the engraving machine. The digital value, in theory, determines the width of the cell and each digital value corresponds to a positive density value.

It has been found that this assumption is incorrect, because it has been determined that the cells in a test cut differ from each other in their dimensions. By selecting only one cell there is a built-in error since a single cell is seldom representative of all of the cells in the test cut. It has been further determined that by only measuring a single dimension, the width, of a single cell, the volume of the cells cannot be accurately determined. The result of these errors and miscalculations has been the inconsistent appearance of the printing produced by cylinders engraved by these machines and excessive use of ink.

This calibration procedure is also unable to take into account short term and long term variations in the engraver. Over the short term there are variations in the size of the cells due to the inability of the engraver to make an identical cut each and every time. Long term variations are experienced as the diamond stylus of the engraver wears.

SUMMARY OF THE INVENTION

The present invention relates to a method for calibrating an engraving head of an engraver which engraves images on a printing member such as a gravure printing cylinder and to the system for calibrating the engraving head. The method includes cutting a plurality of cells in at least one test cut in the printing member or cylinder. An optical image of each cell in the test cut(s) is obtained through the use of a high resolution microscope focused on the printing member. The optical image is converted into electrical signals that are processed to measure each cell's length, width, and face area. These measured values are used to calculate the average cell width, length, depth, face area and volume per unit area. The average cell width, area or volume per unit area is then compared with a standard or desired average value and the engraving head is adjusted or calibrated in accordance with any variation between the computed average value and the standard or desired average value. Once the calibration is completed, the printing member or cylinder is engraved using the calibrated engraving head.

BRIEF DESCRIPTION OF THE DRAWINGS

Other objects and advantages of the invention will become apparent upon reading the following detailed description and upon reference to the accompanying drawings, in which.

DETAILED DESCRIPTION OF PREFERRED EMBODIMENT

Figure 1:
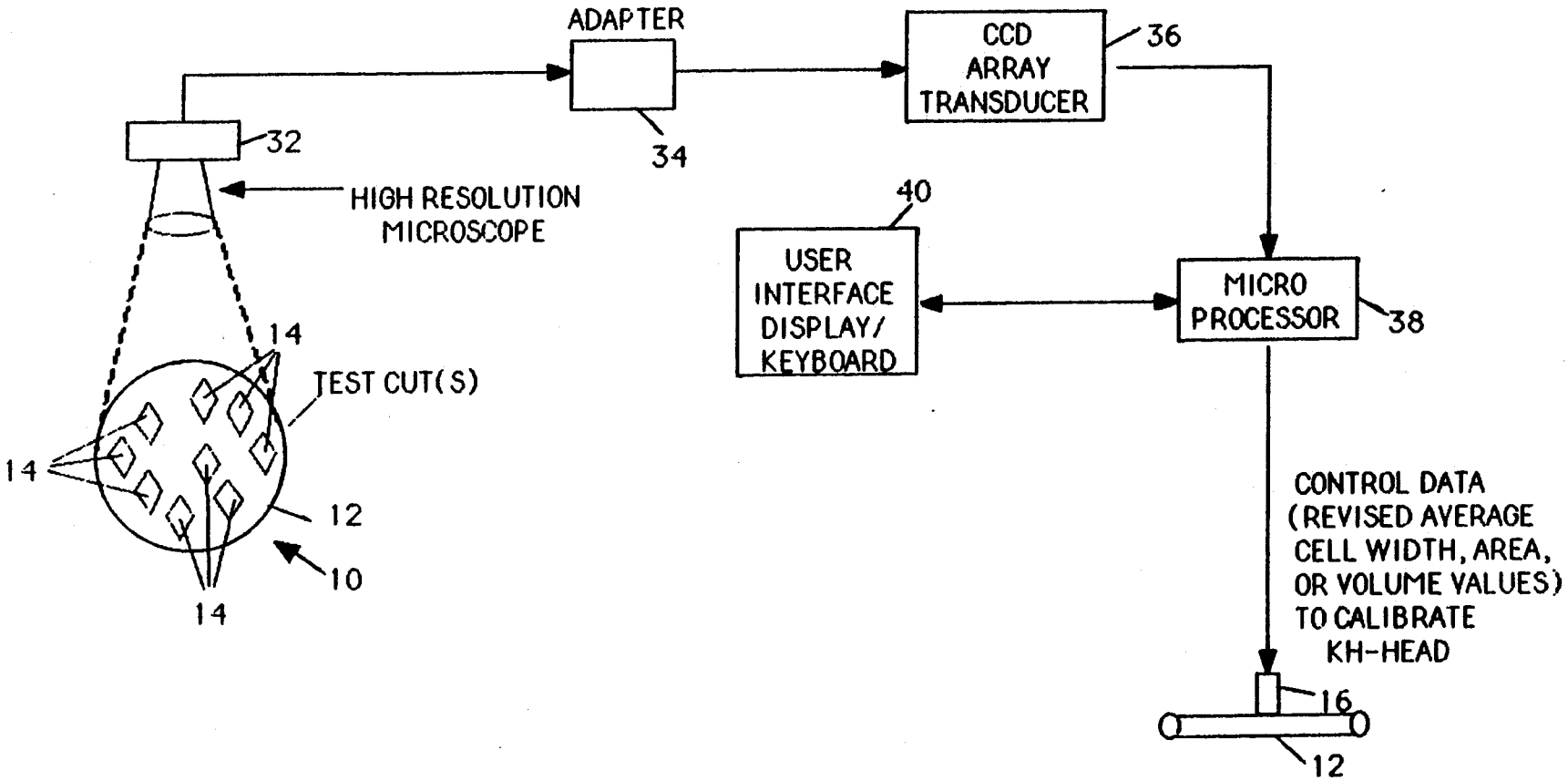
FIG. 1 is a schematic illustration of a printing cylinder engraver calibration system constructed in accordance with the principles of the present invention.

The present invention relates to electronically controlled engraving of gravure printing cylinders, and more specifically, to the calibration of an engraver in an engraving machine used to engrave gravure cylinders or other printing members. An engraving machine typically includes a scanning head for scanning original material that is to be engraved on a gravure cylinder. Original material may alternately be input electronically from a digital tape. The scanning head functions similar to a densitometer in analyzing the original item to be printed. The data gathered by the scanning head serves to control the depth of each cell in relation to the scanned optical information. The scanning head generates a signal that is converted to a digital value corresponding to each available tone. When input is supplied from a digital tape, the digital value is generated from the tape. This digital value is input to the engraving machine and converted to a driving digital value that drives the engraving head 16 of the engraving machine. A given driving digital value will produce a cell 14 of a given width, area, and volume.

Generally, once a gravure cylinder 12 has been copper plated and finished, and prior to engraving an image on the cylinder 12, one or more test cuts 10 are engraved in the cylinder 12 by engraving heads 16 of an engraving machine such as a Helio-Klischograph engraving machine manufactured by Dr. Ing. Rudolf Hell GmbH. Each test cut 10 is intended to reproduce a specific tone value as measured with an optical densitometer.

Figure 3:
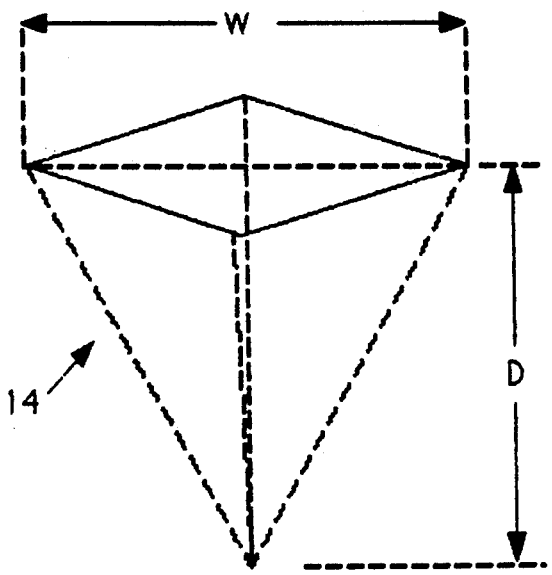
FIG. 3 is an illustration of a cell formed in a test cut that is measured by the system of the present invention.

Each test cut 10 (FIG. 1) engraved in the gravure cylinder 12 is composed of a collection of cells 14 which are intended to print the same optical density time after time. The vibrating diamond stylus of the engraving head 16 cuts into the copper surface of a gravure printing cylinder 12 to form a cell 14 in the shape of an inverted pyramid (FIG. 3). This cell shape ensures consistent and excellent ink release even when printing on smooth and non-porous surfaces. Typically, two test cuts 10 are made by each engraving head 16 of the Helio-Klischograph. Before the image to be printed is engraved onto a cylinder 12, one test cut 10 is normally engraved at the light end of the image which is a tone step corresponding to an optical density of about 0.03. A second test cut is made at the dark end which is a tone step corresponding to a density of about 1.65.

In the past, calibration of an engraving head 16 was accomplished by an operator of the engraving machine selecting one representative cell 14 from the test cut 10 and measuring the width of that cell 14 with an optical microscope. The engraving head 16 was then adjusted to cut a cell 14 of a desired width if that desired width varied from the measured width w. This technique is founded on the assumption that the engraving head 16 which uses a diamond stylus to cut each cell 14, always cuts a cell 14 of the same size when the engraving head 16 receives a signal of the same digital value. This digital value, in theory, determines the width w of the cell cut.

The present invention is based on discovery that the assumption that an engraving head 16 always cuts the same size cell when supplied with the same digital value is not true. It has been found that the same digital value supplied to an engraving head 16 does not result in the same size cell 14 to within an acceptable tolerance. The acceptable tolerance in print density for a tone step cut with a specified digital value is to within plus or minus 0.05 density units of the positive density corresponding to that digital value in the shadows and to within plus or minus 0.02 density units in the highlights. It has been discovered that tone step cuts with the same supplied digital value vary by as much as plus or minus 0.15 density units or more when cut successively by the same engraving head 16.

It has been determined that the print density corresponding to a specific average equivalent cell volume per unit area is typically within a preferred tolerance band. This discovery is complicated, however, by the fact that the same digital value does not always produce a tone step with the same average equivalent cell volume per unit area. If this problem is overcome, consistent tone reproduction is possible.

The solution to this problem is to make the same digital value produce the same average equivalent cell volume per unit area when engraving a tone step. The average equivalent cell volume per unit area is computed by averaging measurements of the individual cells 14 within each test cut. In contrast to the procedures followed in the past, under the procedure of the present invention, all of the cells 14 in a test cut 10 are measured and statistically analyzed to calibrate the engraving head 16. In the past, a single cell was arbitrarily selected and measured, and this cell was assumed to be representative of all the cells in the test cut. Whereas cell volume gives the best calibration, average cell width, or area can be used to improve klischograph calibration to a lesser, but still improved degree.

Figure 2:
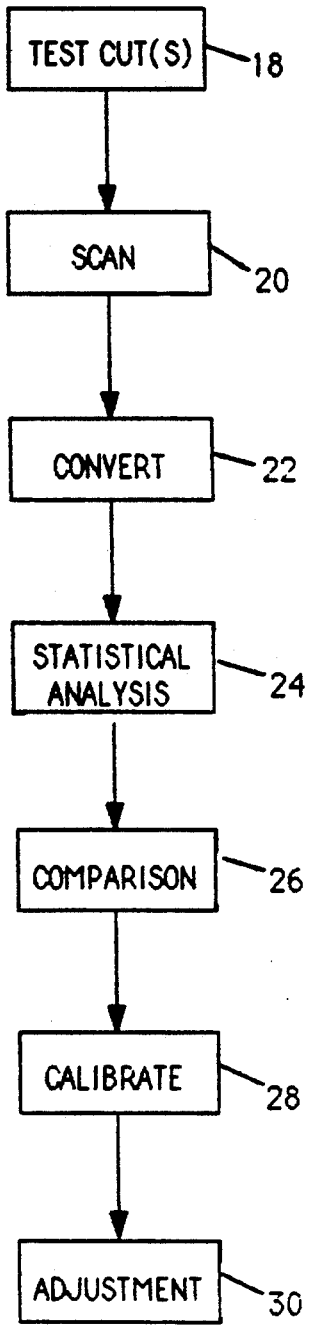
FIG. 2 is a flow diagram of the steps taken in accordance with the method of the present invention.

The procedure or method of calibrating an engraving head 16 of the present invention is set forth in the flow diagram illustrated in FIG. 2. To calibrate each engraving head 16 of an engraving machine to engrave the same tone step to within a selected tolerance, two or more test cuts must be cut in the cylinder 12. This is depicted in the test cut step 18 of FIG. 2. One of the test cuts should be in the light end to produce an optical density of about 0.02 when printed on paper, and the other test cut should be in the dark end to produce an optical density of about 1.65 when printed on paper. Additional test cuts in the midtones can be included to further improve calibration.

The next step, depicted in FIG. 2, is to scan all the cells 14 in the test cut 10 and measure the morphological characteristics such as width w, length or depth d, face area, and volume of each individual cell 14 in the test cut. Preferably, the cells cut at the start of the cutting process when the machine is not at equilibrium and at the finish of the cutting process when the machine is also not at equilibrium are excluded from this scan.

The scanned images are then converted into electrical signals in step 22. These electrical signals representing captured data are used in a statistical analysis in step 24 to compute the average cell volume per unit area for each of the test cuts. The average cell width, area, or volume per unit area is then compared in step 26 with a desired corresponding average value, and the engraving head 16 is calibrated in step 28 in accordance with the variance between the computed average value per unit area and the desired average value. The desired average value can be adjusted in step 30 to take into account new inks, new paper, batch variations in inks and paper, or diamond stylus wear.

The steps of the flow chart of FIG. 2 are performed by the image analyzer system illustrated in FIG. 1. Specifically, once the test cut 10 has been made and the individual cells 14 engraved, all of the cells 14 in the field of view are rapidly measured by a cylinder sitting high resolution microscope 32 or other kind of microscope, focused on the desired test cut, e.g., mounted on an overhanging arm. The microscope 32 is fitted with an adapter 34 for connection to a charged coupled device (CCD) array 36 which converts the optical image seen by the microscope 32 into electrical signals.

Data in the form of electrical signals are then transmitted to a microprocessor 38 that is controlled by a user interface 40 which may be a display terminal and key board. A statistical analysis of the data to compute the average cell volume per unit area is performed by the microprocessor 38. A comparison of the average cell width, area, or volume per unit area with a desired average value is also performed by the microprocessor 38. Once this comparison is completed, the result in the form of a command is transmitted to the engraving head 16 to calibrate the engraving head 16. Any adjustments to each calibration head 16 to take into account different papers, batch variations in inks and papers, or diamond wear can be accomplished through a command from the user interface 40.

One image analyzer system that can be used for the charged coupled device array 36, the microprocessor 38 and the related software is an image analyzer provided by Joyce-Loebl of Garden City, N.Y. Other systems and software can be used to accomplish the same statistical analysis and comparisons.

The calculation of cell volume performed by the microprocessor 38 can be based on one of several theoretical approaches. One theoretical approach is based on a formula developed by the Gravure Research Association. This formula is as follows:

$$\frac{w}{d} = \tan(1/2\alpha_c)$$

where w is the width of the cell 14 illustrated in FIG. 3, d is the depth of the cell 14 in FIG. 3, and $\alpha_c$ is the cutting angle of the stylus of the engraver. The width w can be measured using the high resolution microscope 32, and the depth d can be calculated using the above formula.

This information can then be used in a formula for determining the volume of the cell based on the assumption that the volume of a cell is substantially the volume of a pyramid. This volume may be calculated in accordance with the following formula:

$$V_c = \tfrac{1}{3} A_m d_c$$

where $V_c$ is the volume of a pyramid or cone, $A_m$ is the area of the face of the test cell 14 measured by the high resolution microscope 32, and $d_c$ is the depth of the cell 14 as calculated by the first formula.

Since the volumes of the cells 14 can be calculated using the image analyzer of FIG. 1 and the above formulas, it is possible to plot print density versus cell volume curves. From these curves, it was determined that regardless of what engraving machine or engraving head is used, if the same cell volume could be maintained, it is possible to get the same print density every time within the allowed or selected tolerance band.

Using the image analyzer of FIG. 1, it is also possible to plot a histogram of the number of cells versus cell volume. From these histograms it was found that some cells 14 were of low volume, others were of large volume and still others were in the middle between the low volume and the large volume. In the past, an operator of an engraving machine would select only one cell in calibrating the engraving head 16. If a cell of a small volume was selected, the engraving head 16 would be adjusted to make cells with a larger volume. If the selected cell was not truly representative of all the cells in the test cut, the adjustment would be incorrect resulting in poor print quality and unnecessary consumption of ink.

Using the system of the present invention, however, the average cell volume per unit area is calculated. This calculation takes into account all the variations in the cell volumes. The cell volume per unit area more nearly approximates the actual cell volumes of all the cells resulting in improved print quality and appropriate consumption of ink. Calculating the average value per unit area will also compensate for long term variations as the diamond stylus wears. Values other than volume can be used to calibrate the engraver, e.g. cell width, and cell area. It has been found that these values may also be averaged to improve the calibration, although to a lesser degree.

Prior to the current invention there was no recognition of the advantage of measuring the width, area, or volume of more than one cell 14 or measuring more than one dimension of each cell. By following the procedure of the present invention, increased accuracy in calibrating the engraving head 16, improved print quality and proper consumption of ink are possible.

We claim:

1. A method for calibrating an engraving mechanism of an engraver used to engrave a printing member, comprising:

cutting a plurality of cells in at least one test cut in the printing member;

making an optical image of the plurality of cells in the at least one test cut;

transducing the optical image into electrical signals;

digitally processing the electrical signals representing the optical image of the plurality of cells in the test cut to measure at least one morphological characteristic of each of the imaged cells cut while the engraver was operating at equilibrium conditions;

using said measured morphological characteristics to calculate a morphological parameter value for said test cut;

comparing the calculated morphological parameter value with a pre-determined morphological parameter value; and adjusting the engraving mechanism of the engraver in accordance with any variance between said calculated morphological parameter value and said predetermined morphological parameter value.

2. The method for calibrating the engraving mechanism of an engraver used to engrave a printing member set forth in claim 1 wherein said step of adjusting the engraving mechanism of the engraver includes adjusting said engraving mechanism to cut the cells so that said any variance between said calculated morphological parameter value and said predetermined morphological parameter value falls within a predetermined tolerance band.

3. The method for calibrating the engraving mechanism of an engraver used to engrave a printing member set forth in claim 1 further comprising the step of adjusting the pre-determined morphological parameter value to account for different inks.

4. The method for calibrating the engraving mechanism of an engraver used to engrave a printing member set forth in claim 1 further comprising the step of adjusting the pre-determined morphological parameter value to account for wear of the engraving mechanism.

5. The method for calibrating the engraving mechanism of an engraver used to engrave a printing member set forth in claim 1 wherein said morphological parameter value is an average cell width.

6. The method for calibrating the engraving mechanism of an engraver used to engrave a printing member set forth in claim 1 wherein said morphological parameter value is an average cell area.

7. The method for calibrating the engraving mechanism of an engraver used to engrave a printing member set forth in claim 1 wherein said morphological parameter value is a volume per unit area.

8. A system for calibrating an engraving mechanism of an engraver used to engrave a printing member, comprising:

a viewer mounted in viewing relationship on the printing member for viewing a plurality of cells in a test cut made in the printing member, wherein said plurality of cells has been cut while the engraver was operating at equilibrium conditions;

a converter coupled to said viewer for converting an optical image viewed by said viewer into electrical signals; and an image analyzer coupled to said converter for employing said electrical signals to measure at least one morphological characteristic of each viewed cell in the plurality of cells in the test cut, to calculate a morphological parameter value for the plurality of cells, and to compare the calculated morphological parameter value with a pre-determined morphological parameter value; and means for adjusting said engraving mechanism in response to a variance between said calculated morphological parameter value and said pre-determined morphological parameter value.

9. The system for calibrating the engraving mechanism of an engraver used to engrave a printing member as claimed in claim 8 wherein said viewer is a high resolution microscope.

10. The system for calibrating the engraving mechanism of an engraver used to engrave a printing member as claimed in claim 8 wherein said converter comprises a charged couple device array.

11. The system for calibrating the engraving mechanism of an engraver used to engrave a printing member set forth in claim 8 wherein said morphological parameter value is an average cell width.

12. The system for calibrating the engraving mechanism of an engraver used to engrave a printing member set forth in claim 8 wherein said morphological parameter value is an average cell area.

13. The system for calibrating the engraving mechanism of an engraver used to engrave a printing member set forth in claim 8 wherein said morphological parameter value is a volume per unit area.

14. A method for calibrating a printing member engraving element, comprising the steps of:

using the engraving element to engrave a plurality of cells in a test cut in a printing member;

obtaining an optical image of each cell in the plurality of cells;

converting each optical image into electrical signals;

processing the electrical signals from the images of each cell cut while the engraving element was operating at equilibrium conditions to calculate a morphological parameter value for the test cut;

comparing the calculated morphological parameter value with a pre-determined morphological parameter value; and adjusting said engraving element in accordance with any variance of said calculated morphological parameter value from said pre-determined morphological parameter value.

15. The method for calibrating a printing member engraving element set forth in claim 14 wherein said step of obtaining an optical image of each cell includes measuring the dimensions of each cell.

16. The method for calibrating a printing member engraving element set forth in claim 14 further comprising the step of adjusting said engraving element to accommodate variations in paper, and batch variations in ink and paper.

17. The method for calibrating a printing member engraving element set forth in claim 14 wherein said morphological parameter value is an average cell width.

18. The method for calibrating a printing member engraving element set forth in claim 14 wherein said morphological parameter value is an average cell area.

19. The method for calibrating a printing member engraving element set forth in claim 14 wherein said morphological parameter value is a volume per unit area.

20. A system for calibrating an engraving mechanism of an engraver used to engrave a printing member, comprising:

a viewer mounted in viewing relationship to the printing member for viewing cells in a test cut made in the printing member;

a converter coupled to said viewer for converting an optical image viewed by said viewer into electrical signals; and an image analyzer coupled to said converter for employing said electrical signals to measure at least one morphological characteristic of each cell in the test cut, cut while the engraver was operating at equilibrium conditions, to calculate a morphological parameter value for the test cut based on the morphological characteristics of the measured cells in the test cut, and to compare the calculated morphological parameter value with a pre-determined morphological parameter value; and means for adjusting said engraving mechanism in response to a variance between said calculated morphological parameter value and said pre-determined morphological parameter value.

21. The system for calibrating the engraving mechanism of an engraver used to engrave a printing member set forth in claim 20 wherein said morphological parameter value is an average cell width.

22. The method for calibrating the engraving mechanism of an engraver used to engrave a printing member set forth in claim 20 wherein said morphological parameter value is an average cell area.

23. The method for calibrating the engraving mechanism of an engraver used to engrave a printing member set forth in claim 20 wherein said morphological parameter value is a volume per unit area.

24. A method for calibrating quality control characteristics of a printing member, comprising:

recording in a computer processor a pre-determined morphological characteristic for a test cut;

providing a plurality of cells in at least one test cut in the printing member, wherein each of said plurality of cells is characterized by at least one morphological characteristic;

using an optical imaging device to capture images of the plurality of cells;

transducing the optical images into electronic signals representative thereof;

using the electronic signals to analyze a morphological characteristic of each cell in the plurality of cells with the computer processor, wherein each cell analyzed was cut while the printing member was operating at equilibrium conditions;

responsive to the analysis of the morphological characteristics of the cells and the predetermined morphological characteristic, adjusting the quality control characteristics of the printing member.

* * * * *